US009024183B2

(12) United States Patent
Sakakura

(10) Patent No.: US 9,024,183 B2
(45) Date of Patent: May 5, 2015

(54) SEAL COVER FOR IN-VEHICLE ELECTRIC DEVICE

(75) Inventor: Kouji Sakakura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 420 days.

(21) Appl. No.: 13/456,686

(22) Filed: Apr. 26, 2012

(65) Prior Publication Data

US 2012/0285718 A1 Nov. 15, 2012

(30) Foreign Application Priority Data

May 10, 2011 (JP) ..... 2011-105312

(51) Int. Cl.

| | |
|---|---|
| ***H01J 5/00*** | (2006.01) |
| ***H01J 15/00*** | (2006.01) |
| ***H05K 5/06*** | (2006.01) |
| ***H01R 13/46*** | (2006.01) |
| ***H05K 5/00*** | (2006.01) |
| ***H01L 23/48*** | (2006.01) |
| ***H01R 29/00*** | (2006.01) |
| ***H01R 13/52*** | (2006.01) |
| ***H01R 13/627*** | (2006.01) |
| ***H01R 31/08*** | (2006.01) |
| ***H01R 13/70*** | (2006.01) |
| ***H01R 31/06*** | (2006.01) |
| ***H01R 13/631*** | (2006.01) |

(52) U.S. Cl.

CPC ..... *H01R 13/5202* (2013.01); *H01R 13/5213* (2013.01); *H01R 13/701* (2013.01); *H01R 31/06* (2013.01); *H01R 13/6315* (2013.01)

(58) Field of Classification Search

CPC ..... H01R 13/512; H01R 13/5213; H01R 13/703; H01R 13/7031; H01R 13/7033; H01R 13/7034; H01R 43/22; H05K 5/0069

USPC ..... 174/50.5, 520, 521, 527; 439/149, 188, 439/271, 278, 281, 362, 364, 509, 548, 559, 439/587, 607.55, 607.56, 607.57, 607.58, 439/911

See application file for complete search history.

(56) References Cited

U.S. PATENT DOCUMENTS

| | | | | | |
|---|---|---|---|---|---|
| 5,071,369 | A | * | 12/1991 | Denlinger et al. | 439/595 |
| 5,078,626 | A | * | 1/1992 | Matsuoka et al. | 439/892 |
| 5,165,834 | A | * | 11/1992 | Takenouchi et al. | 411/542 |
| 5,429,527 | A | * | 7/1995 | Nozaki et al. | 439/489 |

(Continued)

FOREIGN PATENT DOCUMENTS

WO 2009056157 5/2009

*Primary Examiner* — Chau N Nguyen
*Assistant Examiner* — Roshn Varghese
(74) *Attorney, Agent, or Firm* — Gerald E. Hespos; Michael J. Porco; Matthew T. Hespos

(57) ABSTRACT

A seal cover includes a cover main body (10) shaped to cover an opening of a case and to be attached to a surface of the case. A seal ring holder (20A) is on the underside of the cover main body (10) and is arranged to fit into the opening. A seal ring (25) is on the outer peripheral surface of the seal ring holder (20A) and closely contacts the inner peripheral surface of the opening. An interlock connector (40) projects from the seal ring holder (20A) for connecting to the waiting connector and sets an energizing circuit in an energized state or a non-energized state upon being connected to or separated from the waiting connector. The interlock connector (40) is mounted on the seal ring holder (20A) to be movable in a direction perpendicular to a connecting direction to the waiting connector.

18 Claims, 13 Drawing Sheets

(56) References Cited

U.S. PATENT DOCUMENTS

| | | | | | |
|---|---|---|---|---|---|
| 5,538,445 | A * | 7/1996 | Grzybowski et al. | 439/752 |
| 5,755,600 | A * | 5/1998 | Yoshida | 439/752 |
| 5,816,834 | A * | 10/1998 | Nimura et al. | 439/188 |
| 5,820,401 | A * | 10/1998 | Hasz et al. | 439/364 |
| 5,928,038 | A * | 7/1999 | Berg et al. | 439/752 |
| 5,997,328 | A * | 12/1999 | Kodama et al. | 439/247 |
| 5,997,351 | A * | 12/1999 | Okabe | 439/587 |
| 6,183,275 | B1 * | 2/2001 | Okura et al. | 439/157 |
| 7,338,297 | B2 * | 3/2008 | Maegawa et al. | 439/79 |
| 7,354,308 | B2 * | 4/2008 | Iwahori | 439/587 |
| 2001/0007801 | A1 * | 7/2001 | Nimura | 439/489 |
| 2010/0255728 | A1 | 10/2010 | Matsuoka et al. | |
| 2011/0053403 | A1 * | 3/2011 | Tsuruta et al. | 439/345 |
| 2011/0100704 | A1 * | 5/2011 | Iida et al. | 174/520 |

* cited by examiner

SEAL COVER FOR IN-VEHICLE ELECTRIC DEVICE

1. FIELD OF THE INVENTION

The invention relates to a seal cover to be removably attached to close an opening such as a work opening provided in a case of an in-vehicle electric device.

2. DESCRIPTION OF THE RELATED ART

An electric vehicle is likely to have a device mounted in a case. The case typically has an opening for accessing internal connectors, and a seal cover or service cover is attached to the opening. U.S. Patent Application Publication No. 2010/0255728 discloses a conventional seal cover with a main body capable of covering an opening. A fitting on the underside of the main body and can fit into the opening and locking pieces are provided to engage the opening. A seal ring is mounted on the outer peripheral surface of the fitting and closely contacts the inner peripheral surface of the opening to provide sealing when the seal cover is attached to the opening. Thus, water and external matter cannot enter through the opening.

An operation position in the case preferably is not energized when the seal cover is removed. Thus, an interlock mechanism has been proposed for turning an energizing circuit on and off as the seal cover is attached and removed. Specifically, two contact terminals can be drawn out from the energizing circuit and can be accommodated in a waiting connector in the case. On the other hand, an interlock connector may project from the fitting of the seal cover. The interlock connector connects the contact terminals of the waiting connector as the seal cover is attached, thereby setting the energizing circuit in an energized state. The interlock connector separates from the contact terminals of the waiting connector as the seal cover is removed to set the energizing circuit in a non-energized state.

However, the connecting operation is slower because of the forcible connection of the interlock connector and the waiting connector when the fitting of the seal cover is fit into the opening. Further the fitting may be displaced as the interlock connector and the waiting connector are connected thereby making a squeeze margin of the seal ring uneven and adversely affecting the sealing function.

The invention was completed based on the above situation and an object thereof is to improve connection accuracy between an interlock connector on a seal cover and a mating waiting connector in a case.

SUMMARY OF THE INVENTION

The invention relates to a seal cover that is removably attachable to an opening in a case that houses an in-vehicle electric device. The seal cover has a cover main body that can be attached to a surface of the case and that is shaped to cover the opening of the case. At least one seal ring holder is arranged on the underside of the cover main body and can fit into the opening. A seal ring is mounted on the seal ring holder and is held in close contact with the opening. An interlock connector projects from the seal ring holder and is connectable to a waiting connector of the electric device for setting an electric member of the electric device in a specified electric state. The interlock connector is movable in a direction aligned at an angle, preferably a right angle, to a connecting direction to the waiting connector.

The interlock connector faces the waiting connector when the seal ring holder on the cover main body of the seal cover is fit into the opening of the case. The axial centers of the waiting connector and the interlock connector may deviate from each other due to a tolerance of the arrangement position of the waiting connector or the like. However, the interlock connector can float with respect to the seal ring holder and can move at an angle to the connecting direction to the waiting connector. Thus, the connectors can be connected properly with high accuracy while being centered.

The interlock connector and the waiting connector are connected smoothly and, consequently, the seal cover can be attached efficiently. Further, no unnecessary moving force acts on the seal ring holder in a radial direction, and the seal ring is not squeezed unevenly in a radial direction. Thus, good sealing obtained over the entire circumference of the opening.

The waiting connector may include a switch function unit for switching a state of an energizing circuit between an energized state and a non-energized state. The interlock connector that projects from the seal ring holder sets the energizing circuit in the energized state or the non-energized state upon being connected to or separated from the waiting connector.

The interlock connector may have a base and a connector portion to be connected to the waiting connector may project from the base. A groove may be formed in the outer peripheral surface of the seal ring holder and the base of the interlock connector may be insertable into the groove with a clearance in a width direction.

The base preferably includes at least one resilient lock that is to be engaged with an engaging portion in the insertion groove to retain the base. The lock may project toward a front side in an inserting direction of the base. The resilient lock preferably is movable along the inserting direction between a position where the base contact the back surface of the groove and a position where the resilient lock engages the engaging portion.

The resilient lock preferably engages the engaging portion to retain the base of the interlock connector when the base is inserted a specified distance into the insertion groove in the seal ring holder through an opening in the outer peripheral surface. Thus, the interlock connector is supported in a floating state and can movable in directions intersecting the connecting direction i.e. forward, back, left and right.

A mounting hole may be formed in a surface of the seal ring holder that faces the waiting connector and the base of the interlock connector may be fit into the mounting hole through the opening. The respective sides of the base may be engaged with resilient locking pieces on four sides of the mounting hole to support the base in the floating state. However, this structure is complicated since the resilient locking pieces need to be provided at four positions.

Alternatively, a floating function that enables the base of the interlock connector to move in four directions intersecting the connecting direction can be realized by inserting the base into the insertion groove through the opening in the outer peripheral surface and retaining the base by the resilient locking piece. Thus, the floating function can be realized by a simple structure including only one resilient locking piece.

The seal ring holder preferably is mounted on the cover main body at an angle and preferably a right angle to a fitting direction into the opening.

The seal ring holder and the opening of the case can be fit while being centered. Thus, a squeeze amount of the seal ring can be made more uniform over the entire circumference and sealing ability of the opening is improved.

An insert nut preferably is at least partly embedded in the seal ring holder and an insertion hole is provided in the cover main body so that a screw can be engaged into the insert nut to floatingly mount the seal ring holder to the cover main body.

The nut preferably is insertable into the insertion hole with a clearance. A washer preferably is between the screw and the insertion hole. A clearance preferably is provided between the washer and the cover main body in an axial direction of the nut.

At least one pin preferably is provided on one of the seal ring holder and the cover main body and at least one restricting hole preferably is provided in the other of the seal ring holder and the cover main body to prevent erroneous mounting of the seal ring holder on the cover main body and/or a rotational displacement of the seal ring holder with respect to the main body.

A clearance preferably is provided between the pin and the restricting hole.

The clearance between the pin and the restricting hole preferably is smaller than the clearance between the nut and the insertion hole.

These and other objects, features and advantages of the present invention will become more apparent upon reading of the following detailed description of preferred embodiments and accompanying drawings.

DETAILED DESCRIPTION OF THE PREFERRED EMBODIMENTS

A seal cover in accordance with an embodiment of the invention is provided for simultaneously closing two juxtaposed work openings 110 in one surface of an a shield case 100 that houses an electric device. Further, an interlock mechanism is provided that sets an electric member (such as a circuit) in a specified electric state, e.g. turns on and off an energizing circuit for the electric device, as this seal cover is attached and removed. Although not shown, a waiting connector accommodating two contact terminals drawn out from the electric member (e.g. the energizing circuit) is mounted on a terminal block in the case.

Figure 1:
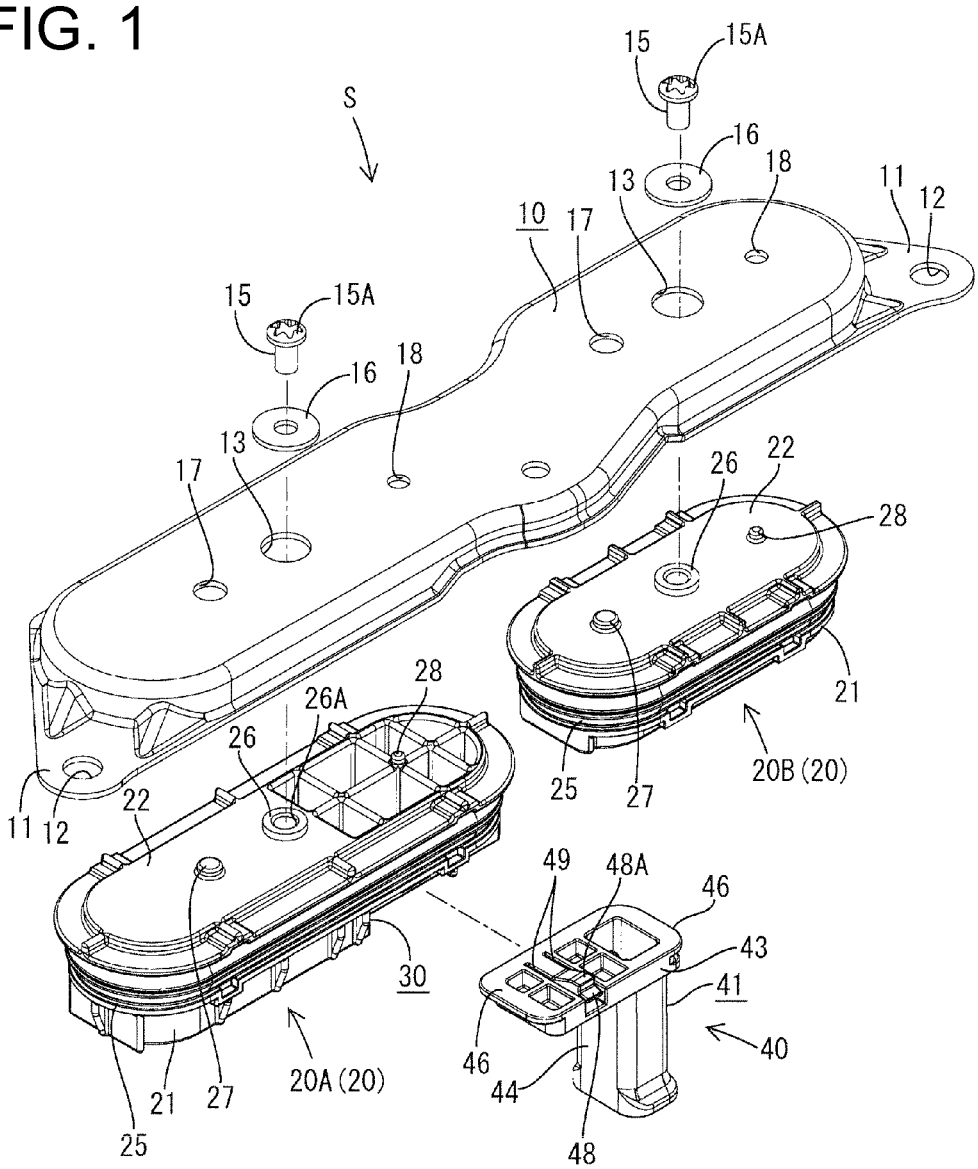
FIG. 1 is an exploded perspective view of a seal cover according to one embodiment of the invention.

As shown in FIG. 1, the seal cover S includes a cover main body 10, two seal ring holders 20 and an interlock connector 40.

The main body 10 is formed by press-working a conductive plate, such as a steel plate, and defines a long narrow substantially elliptical inverted shallow saucer capable of covering the both openings of the case. Specifically, the two seal ring holders 20 are arranged substantially side by side on the underside of the cover main body 10. Mounting plates 11 project from both ends of the opening edge on the underside of the cover main body 10 in a length direction, and each mounting plate 11 has an insertion hole 12 for a bolt.

Figure 2:
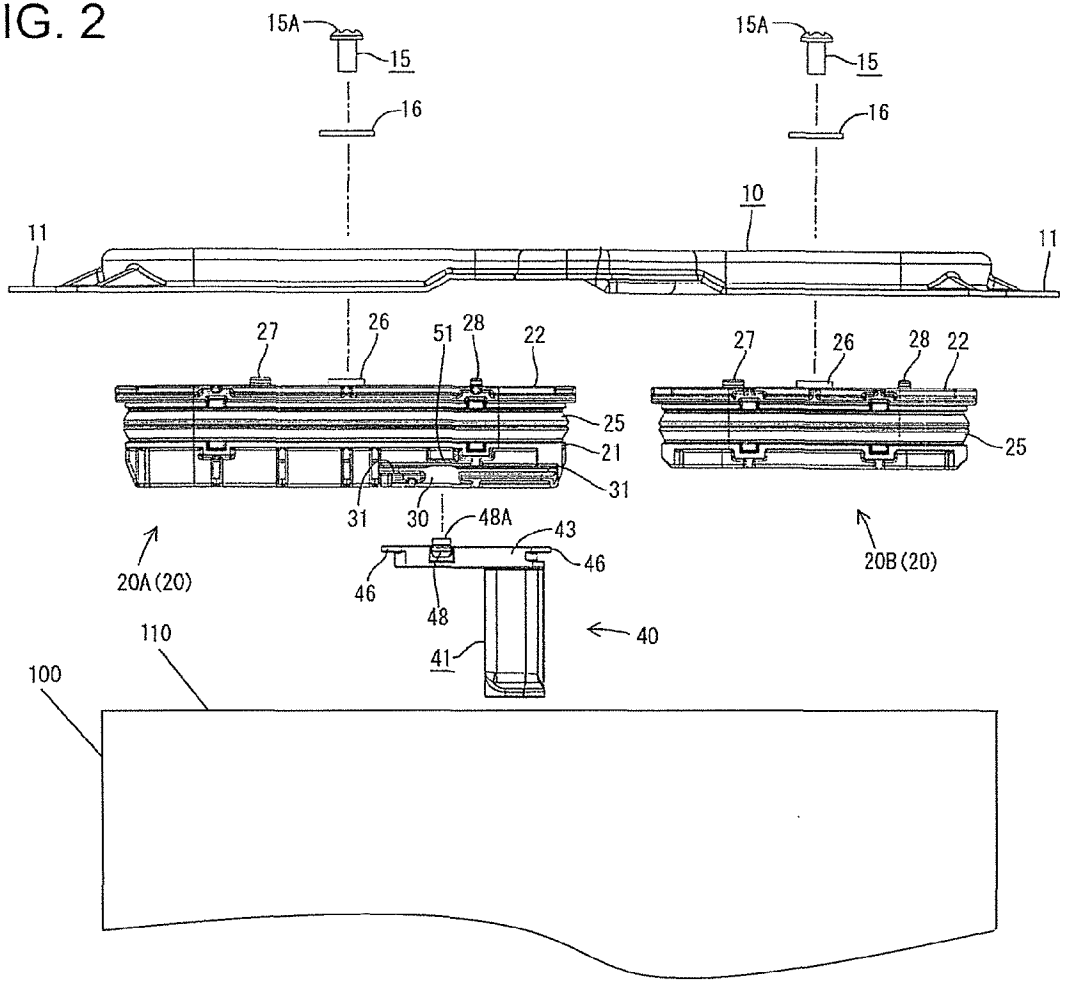
FIG. 2 is an exploded front view of the seal cover of FIG. 1.
Figure 3:
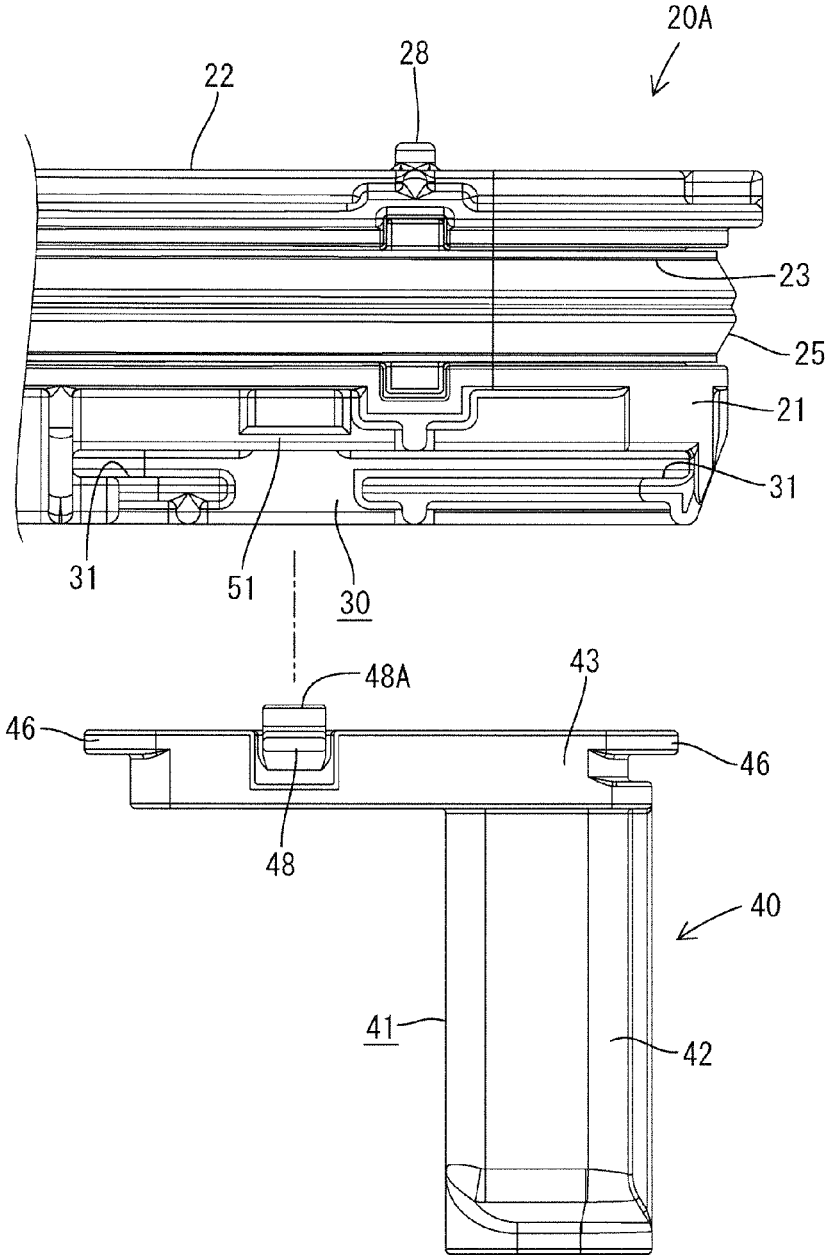
FIG. 3 is a partial enlarged view of FIG. 2.
Figure 4:
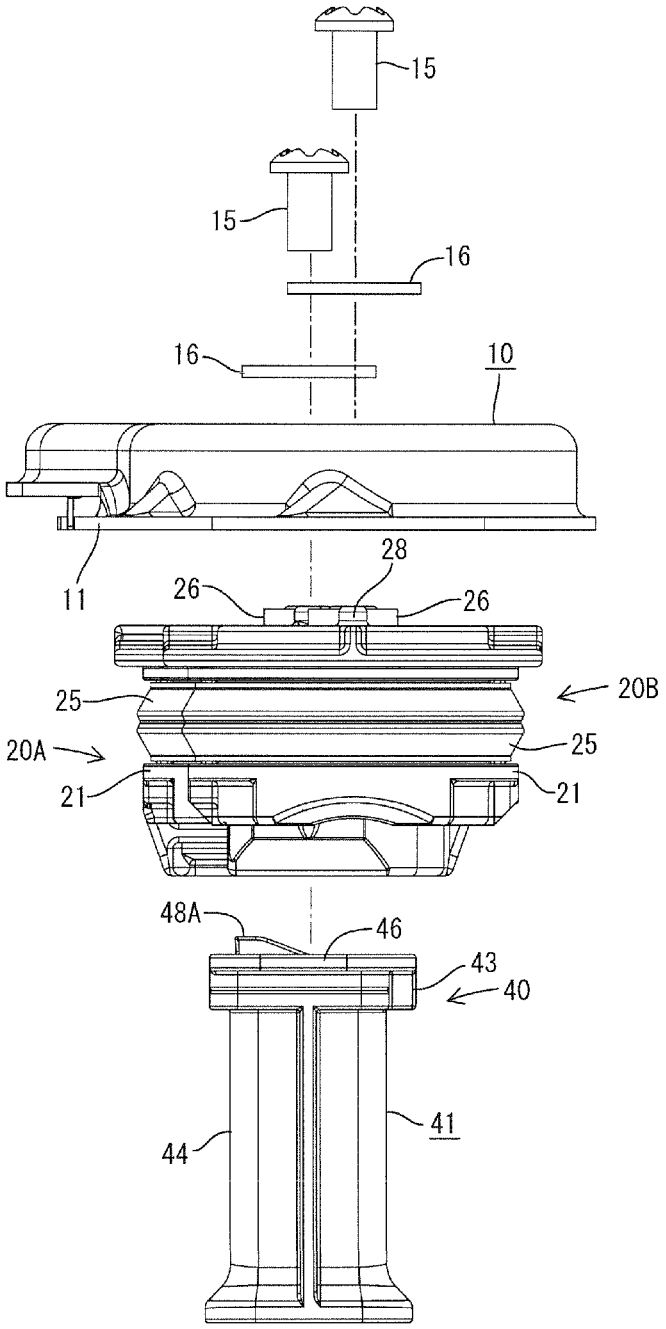
FIG. 4 is an exploded side view of the seal cover.
Figure 5:
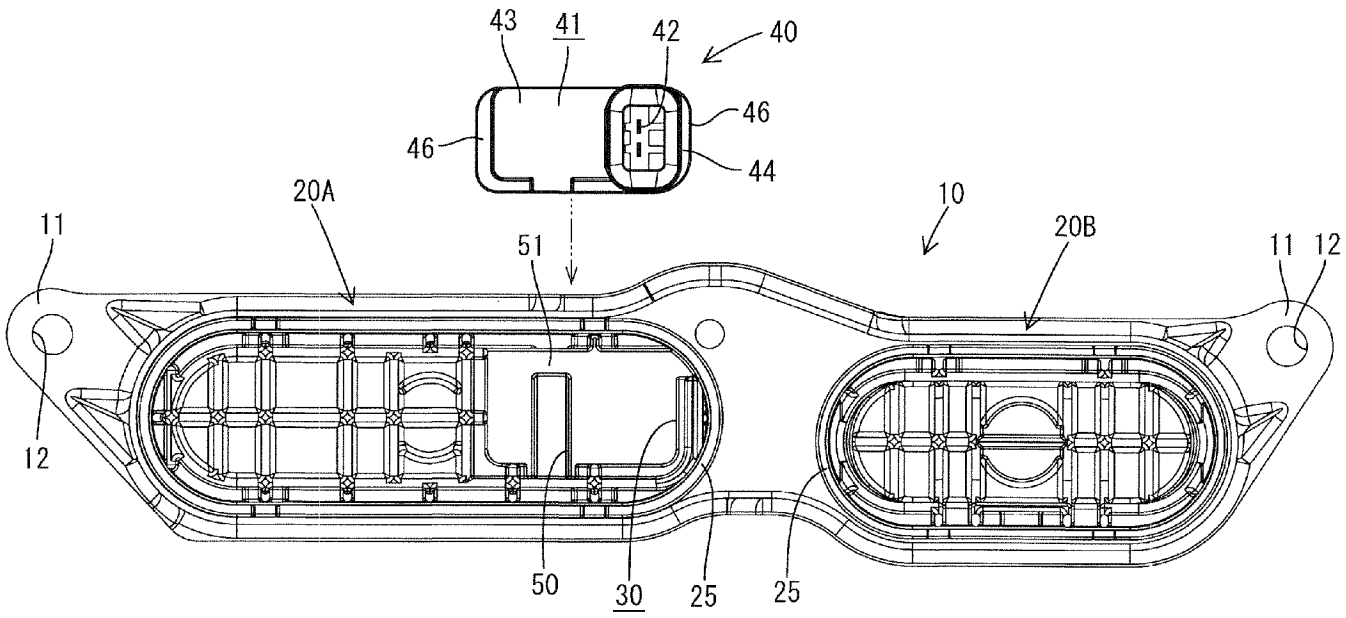
FIG. 5 is a bottom view showing an operation of mounting an interlock connector.
Figure 6:
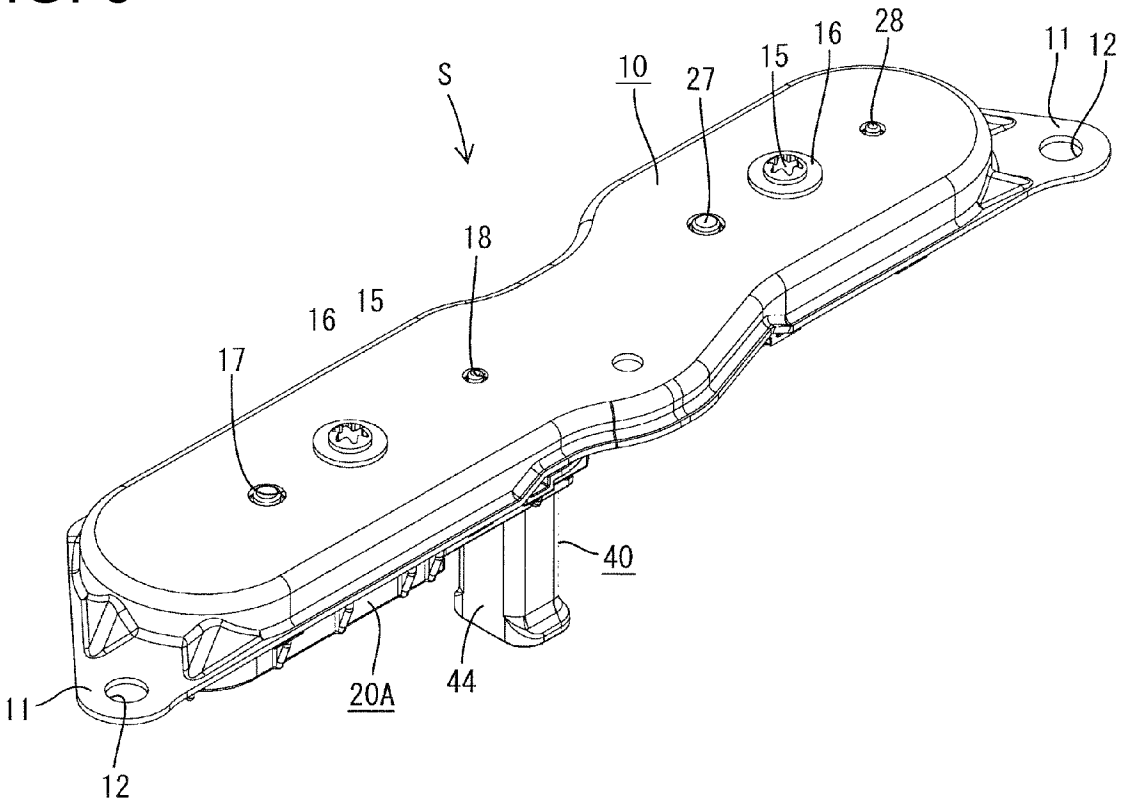
FIG. 6 is a perspective view of the assembled seal cover.
Figure 7:
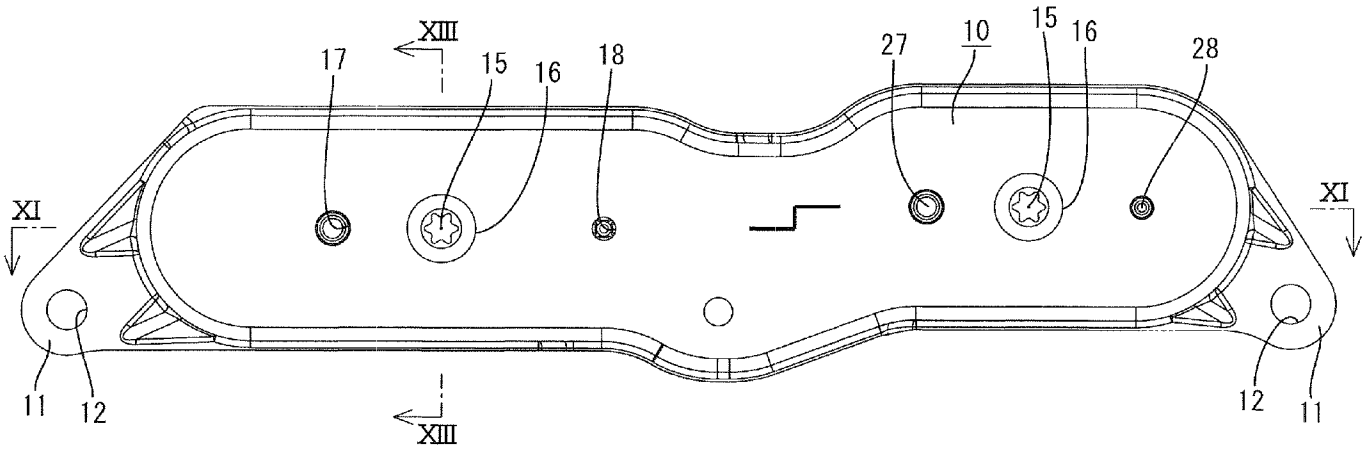
FIG. 7 is a plan view of the seal cover of FIG. 6.

The seal ring holder 20 (hereinafter, merely referred to as the "holder" 20) is made e.g. of synthetic resin and a thick main body 21 and a lid plate 22 formed on the cover main body 21. The cover main body 21 has a substantially elliptical plan view and is configured to fit into the opening of the case. The lid plate 22 is larger than the main body 21 and is configured for covering the edge of the opening. The two openings of the case differ in size. Thus, the holders 20 include a first holder 20A with a relatively long major axis and a second holder 20B with a relatively short major axis. Further, as shown in FIG. 2, the thickness of the main body 21 of the first holder 20A is larger. Note that the two holders 20A, 20B are referred to as the holders 20 when a description common to both is given. It should be understood that the main body 21 may have a differing number of holders 21 such as only one holder or three or more holders.

Figure 11:
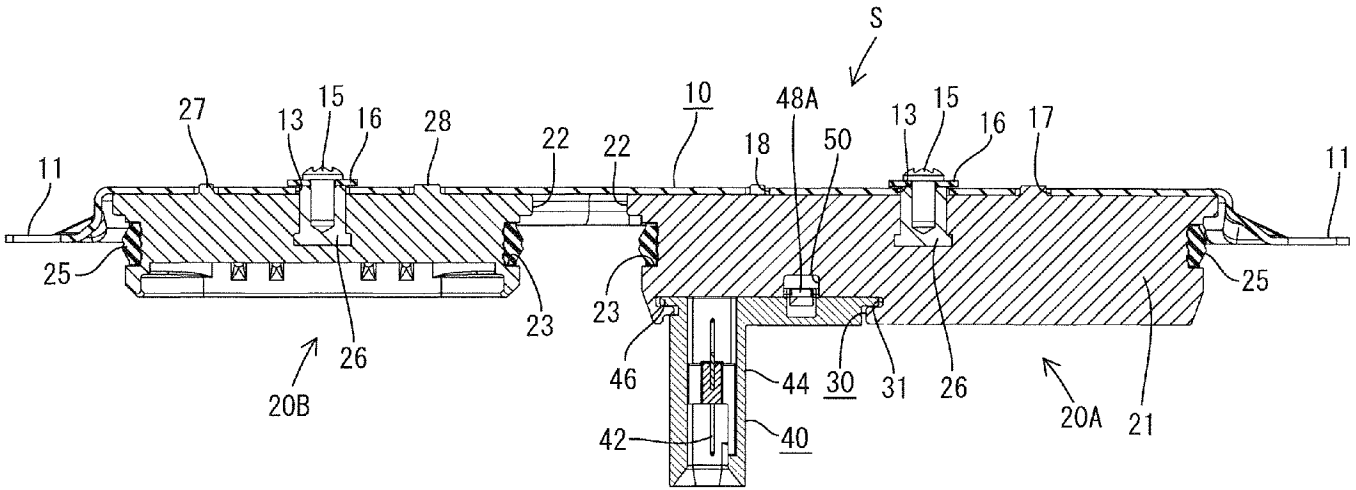
FIG. 11 is a section along XI-XI of FIG. 7.

As shown in FIG. 11, a seal mounting groove 23 is formed around the entire outer peripheral surface of the main body 21 of each holder 20 near the upper end and an annular seal ring 25 is mounted in the seal mounting groove 23. Outer dimensions of the seal ring 25 are slightly larger than inner dimensions of the corresponding opening.

The two holders 20A, 20B are arranged substantially side by side on the underside of the cover main body 10 and are supported to float or displace along or with respect to the underside surface of the cover main body 10.

A substantially cylindrical nut 26 projects at the center of the lid plate 22 of the holder 20. The nut 26 is embedded by insert molding so that an upper end portion projects a specified length from the upper surface of the lid plate 22. The projecting length of the nut 26 is slightly longer than the thickness of the cover main body 10.

Figure 12:
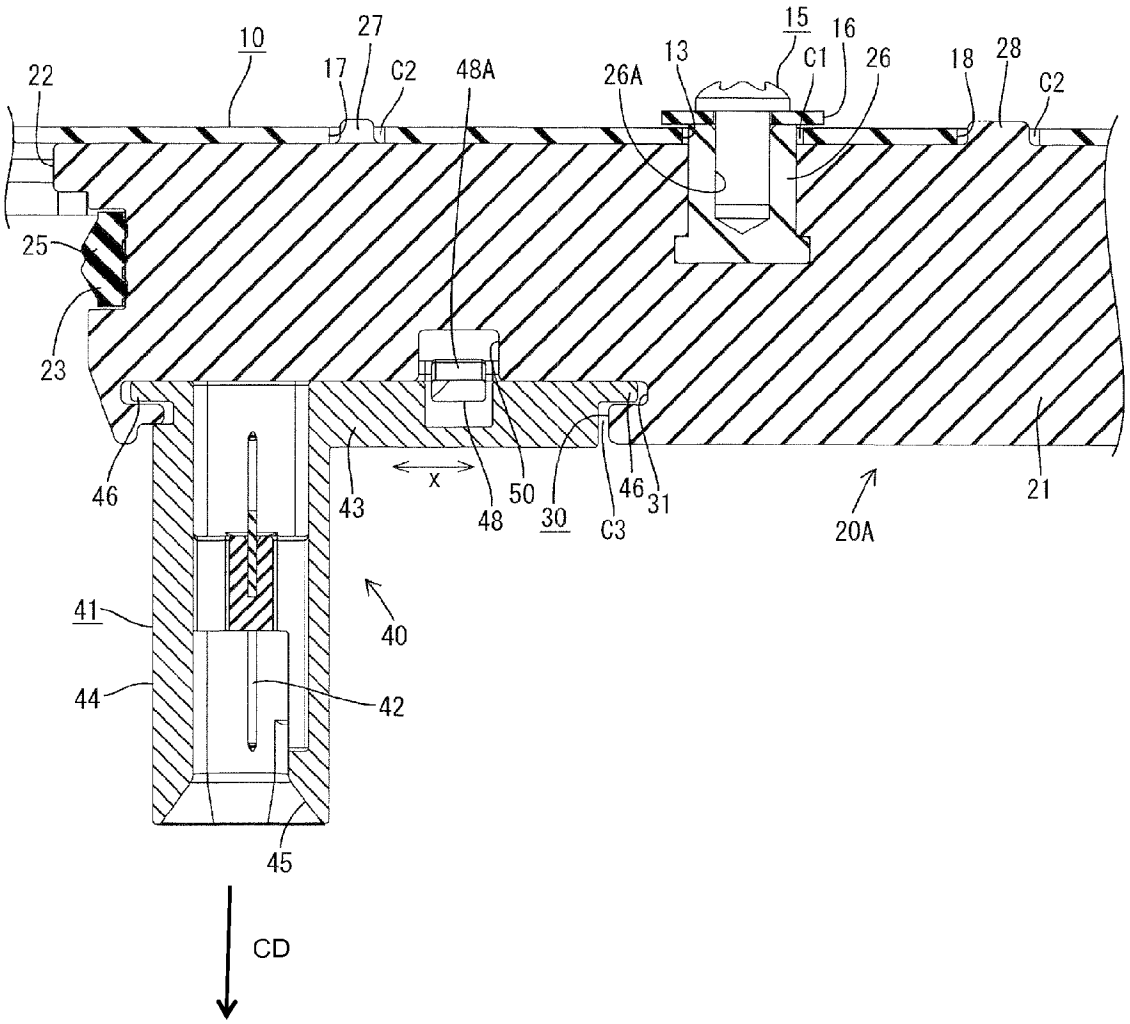
FIG. 12 is a partial enlarged view of FIG. 11.
Figure 13:
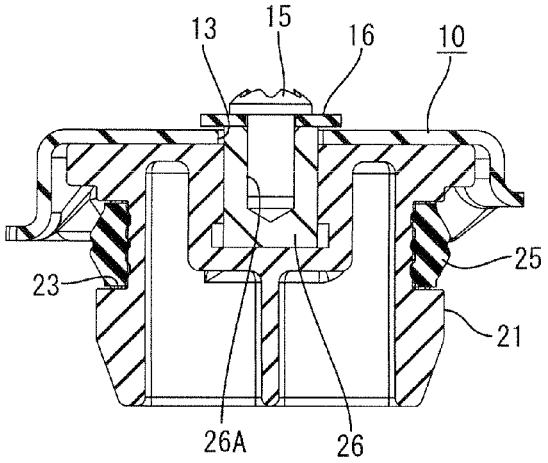
FIG. 13 is a section along XIII-XIII of FIG. 7.

On the other hand, substantially circular insertion holes 13 penetrate between the top and underside surfaces in arrangement areas of the cover main body 10 for the holders 20 and the upper end of the nut 26 projecting from the upper surface of the holder 20 can be inserted into the respective insertion hole 13 with a clearance C1 (see FIG. 12). A screw 15 is engaged threadedly with the screw hole 26A of the nut 26, and a washer 16 larger than the insertion hole 13 is disposed below the head 15A of the screw 15.

Two pins 27, 28 project from the upper surface of the lid plate 22 of each holder 20 at opposite sides of the nut 26 in the length direction. Diameters of the respective pins 27, 28 and/or distances from the nut 26 differ. Projecting heights of the pins 27, 28 are slightly higher than a projecting height of the nut 26.

Restricting holes 17, 18 are formed in the arrangement areas of the main body 10 for each holder 20 and penetrate between the top and underside surfaces at the opposite sides of the insertion hole 13. The restricting holes 17, 18 can receive the respective pins 27, 28 projecting from the upper surface of the holder 20 with a clearance C2 (see FIG. 12). The clearances C2 between the pins 27, 28 and the corresponding restricting holes 17, 18 are smaller than the clearance C1 between the nut 26 and the insertion hole 13.

The interlock connector 40 forming an interlock mechanism together with the waiting connector provided in the case is mounted to the first holding member 20A to be able to float or displace with respect to the holder 20.

As also shown in FIG. 12, the interlock connector 40 has a housing 41 made of synthetic resin. The housing 41 accommodates a shorting terminal 42 for connecting the two contact terminals in the waiting connector. More specifically, the housing 41 includes a base 43 and a connector portion 44. The base 43 is substantially rectangular in a plan view. The connector portion 44 is a substantially rectangular tube that hangs down from one longitudinal end of the base 43. The shorting terminal 42 is accommodated in the connector portion 44. A guiding surface 45 is formed on the inner peripheral surface of a lower end of the connector portion 44 and is widened toward the opening edge.

The interlock connector 40 is inserted into an insertion groove 30 in the outer peripheral surface of the first holder 20A and is supported so that the base 43 of the housing 41 can float.

More specifically, slide plates 46 are formed on both shorter side edges of the base 43 of the housing 41 to be flush with the upper surface. Further, a resilient locking piece 48 is provided in an area of the base 30 at a side distant from the connector portion 44. The resilient locking piece 48 is cantilevered from a back side toward a front side in an inserting direction of the base 43 by forming slits 49 at opposite sides of the resilient locking piece 48. A locking projection 48A is formed near an extending end of the resilient locking piece 48, and this extending end is resiliently displaceable downward.

Figure 8:
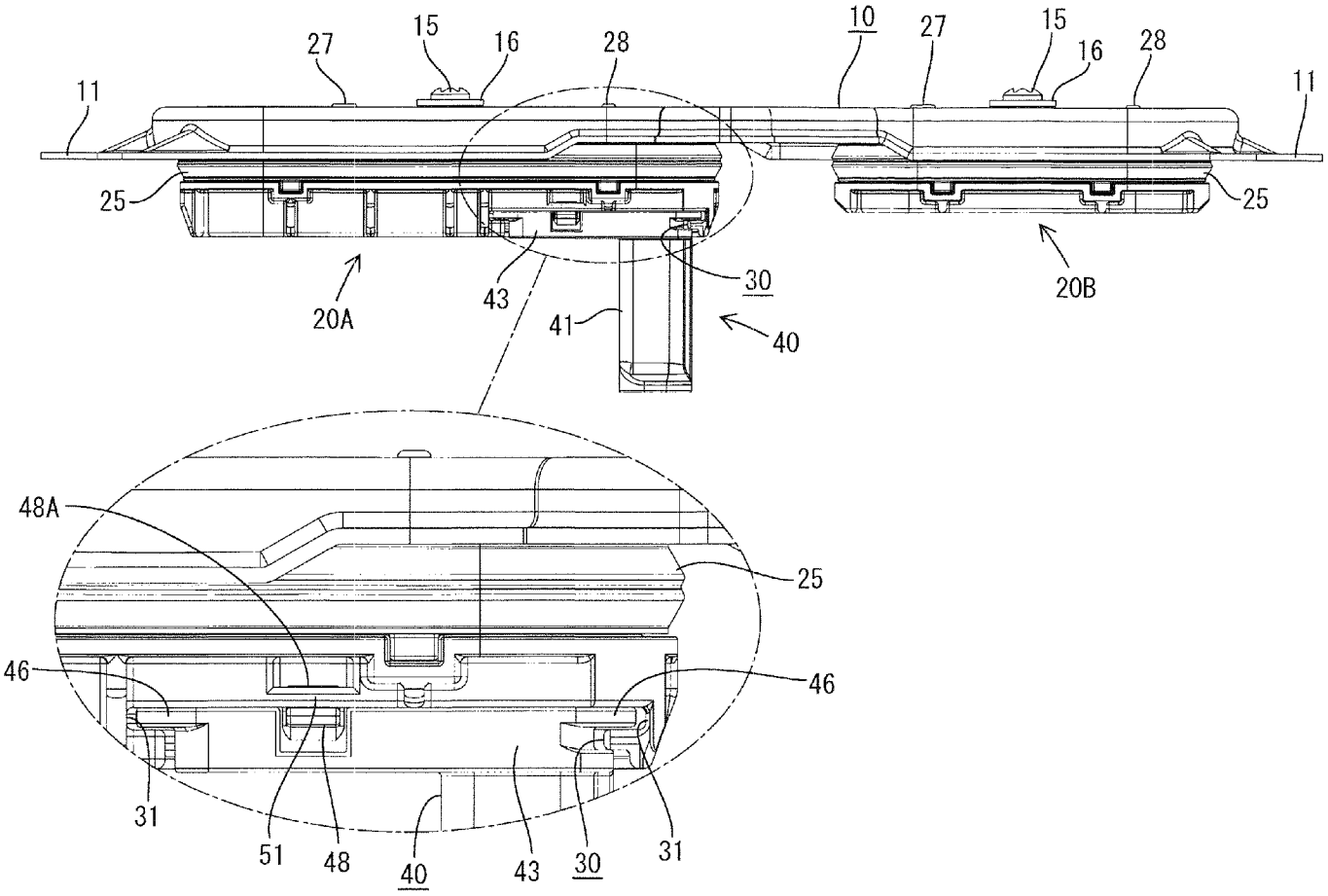
FIG. 8 is a front view of the seal cover of FIG. 6.
Figure 9:
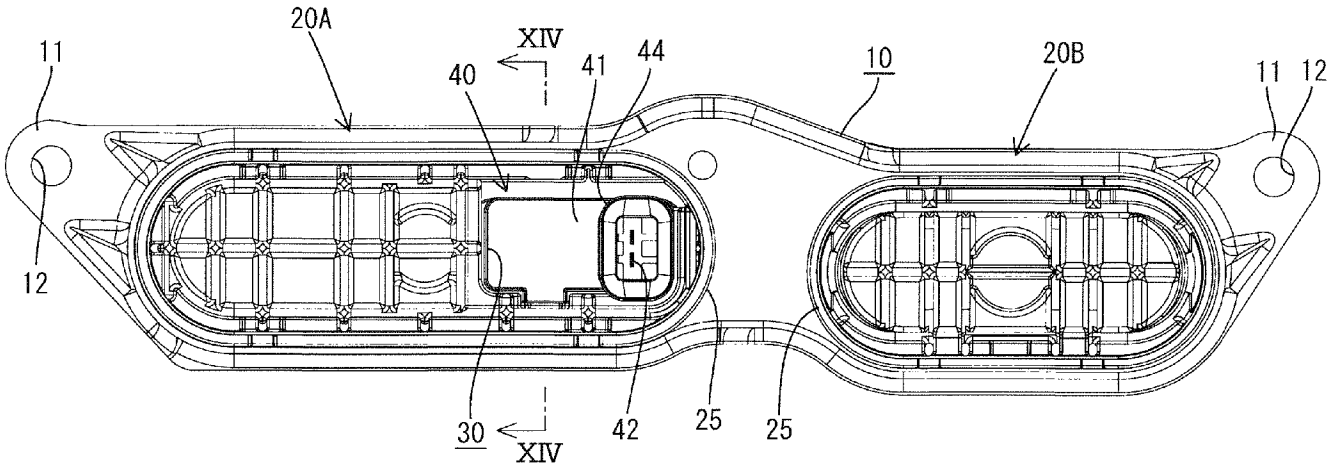
FIG. 9 is a bottom view of the seal cover of FIG. 6.
Figure 10:
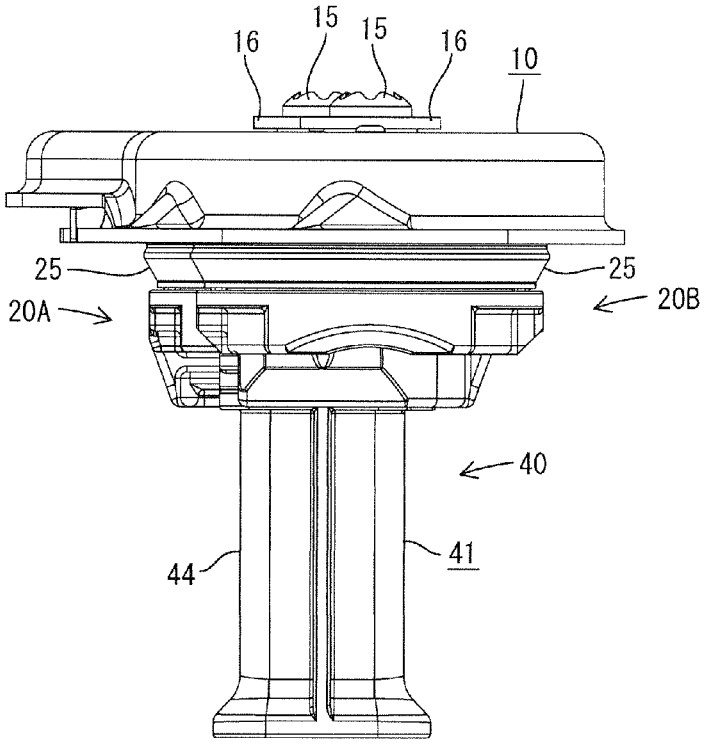
FIG. 10 is a side view of the seal cover of FIG. 6.

As also shown in FIG. 8, the insertion groove 30 is open in the lower surface and the outer peripheral surface on the front side and is closed on the back side by a back surface in a right area of the main body 21 of the first holder 20A when viewed from the front and is lower than the seal mounting groove 23.

As shown in FIG. 12, the insertion groove 30 is wider than the width of the base 43 of the housing 41 by a specified dimension and guide grooves 31 are formed at positions in the insertion groove 30 near the ceiling surface for receiving left and right slide plates 46 projecting from the left and right side surfaces of the base 43. The width of the guide grooves 31 exceeds a distance between the outer edges of the left and right plates 46 by the same predetermined dimension described above.

An escaping groove 50 extends back at a position of the ceiling surface of the insertion groove 30 corresponding to the insertion position of the resilient locking piece 48 while leaving an engaging portion 51 on a front edge for engaging the locking projection 48A of the resilient locking piece 48. The escaping groove 50 is wider than the locking projection 48A by the same predetermined dimension described above. More particularly, specified clearances C3 for permitting the base 43 to move laterally in the insertion groove 30, as shown by arrows x of FIG. 12, are provided between the base 43 (including the slide plates 46) of the housing 41 and the insertion groove 30 (including the guide grooves 31) and between the locking projection 48A of the resilient locking piece 48 and the escaping groove 50.

Figure 14:
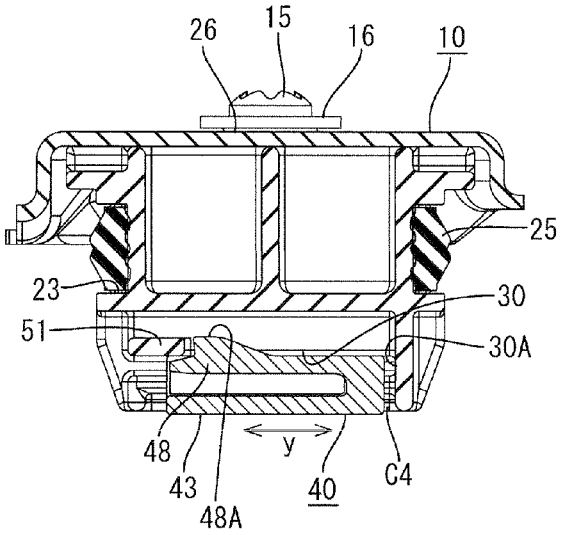
FIG. 14 is a section along XIV-XIV of FIG. 9.

Further, the base 43 of the housing 41 is inserted into the insertion groove 30 from the front while both slide plates 46 are inserted into the guide grooves 31, and pushed while resiliently displacing the resilient locking piece 48 in an intermediate point of an inserting operation. The locking projection 48A passes the engaging portion 51 when the base 43 is pushed to a specified depth. As a result, the locking projection 48A engages the engaging portion 51 to retain the base 43 as shown in FIG. 14 while the resilient locking piece 48 is making a returning movement. At this time, a specified clearance is formed between the rear surface of the base 43 and a back surface 30A of the insertion groove 30. In other words, a specified clearance C4 is provided to permit the base 43 to move in forward and backward directions, as shown by arrows y of FIG. 14, until the base 43 of the housing 41 contacts the back surface 30 and/or the locking projection 48A contacts the engaging portion 51.

The seal cover S is assembled by mounting the seal rings 25 into the seal mounting grooves 23 of the first and second holders 20A, 20B. Subsequently, the interlock connector 40 is held in the insertion groove 30 of the first holder 20A. More particularly, the base 43 of the housing 41 is inserted into the insertion groove 30 with the resilient locking piece 48 facing forward, and the interlock connector 40 is supported in a state to be able to float in forward and backward directions y and lateral direction x when the resilient locking piece 48 is engaged with the engaging portion 51 to retain the base 43.

The first and second holders 20A, 20B then are mounted in the corresponding areas on the underside surface of the cover main body 10. For example, the first holder 20A is mounted on the underside surface in a lateral (e.g. left) area of the cover main body 10 when viewed from front, and brought into contact with the underside surface while the pins 27, 28 at opposite sides of the nut 26 are inserted into the restricting holes 17, 18 and the nut 26 is inserted into the insertion hole 13. At this time, if the first holder 20A is in a reversed orientation, the respective pins 27, 28 do not match the restricting holes 17, 18, thereby restricting the mounting, i.e. preventing erroneous mounting. In this case, the first holder 20A is set in a proper posture and mounted again.

The washer 16 is placed on the upper surface of the nut 26 and the screw 15 is screwed into the screw hole 26A of the nut 26 when the properly oriented first holder 20A contacts the underside surface of the cover main body 10. At this time, the pins 27, 28 on the upper surface of the first holder 20A are in the corresponding restricting holes 17, 18 of the cover main body 10 and prevent the first holder 20A from rotating as the screw 15 is tightened. Therefore, the screw 15 is screwed efficiently.

The projecting length of the nut 26 exceeds the thickness of the cover main body 10. Thus, the washer 16 is fixed to the upper surface of the nut 26 and a clearance is formed between the washer 16 and the cover main body 10 in an axial direction of the nut 26, as shown in FIG. 12, when the screwing of the screw 15 is completed. Thus, the first holder 20A is prevented from falling down from the underside surface of the cover main body 10 by the contact of the washer 16 with the edge of the insertion hole 13 and, on the other hand, is mounted to be slightly movable along the axial direction of the nut 26 at the underside of the cover main body 10.

The clearances C1, C2 are provided between the nut 26 and the insertion hole 13 and between the pins 27, 28 and the restricting holes 17, 18. Thus, the first holder 20A is supported in a floating state and can move with respect to the main body 10 in all directions. The clearances C2 between the pins 27, 28 and the restricting holes 17, 18 are smaller than the clearance C1 between the nut 26 and the insertion hole 13. Thus, movements of the first holder 20A are prevented by the contact of the pins 27, 28 with the inner edges of the restricting holes 17, 18. The contact of a resin member with a metal prevents production of metal powder that would result from collision of metals.

The second holder 20B is to be fixed and mounted by the screw 15 in a lateral area of the underside surface of the cover main body 10 in a procedure similar to that described above and also is supported in a floating state to be movable in all directions.

The assembled seal cover S is attached to cover both openings of the shield case. More particularly, the seal cover S is set in a posture conforming to the juxtaposition of the openings and the first and second holders 20A, 20B are fit respectively into the corresponding openings. Accordingly, the interlock connector 40 hanging down from the lower surface of the first holder 20A is inserted deeply into the case to face the waiting connector provided on the terminal block from above.

The cover main body 10 then is pressed toward the upper surface of the seal cover. As a result, the first and second holders 20A, 20B are pushed into the corresponding openings while the seal rings 25 thereof are squeezed in a radial direction. The first and second holders 20A, 20B are supported to float in all directions, and hence can be fit while being centered with respect to the corresponding openings. In this way, the first and second holders 20A, 20B are fit in close contact with the inner peripheral surfaces of the corresponding openings while the seal rings 25 are squeezed substantially uniformly over the entire periphery.

Simultaneously, the mating waiting connector is fit into the connector portion 44 formed in the housing 41 of the interlock connector 40 from the guiding surface 45 side. The housing 41 is supported in the insertion groove 30 of the first holder 20A in a floating state to be movable in forward and backward directions y and lateral directions x. Thus, the connector portion 44 of the housing 41 is centered while being moved in forward and backward directions y and lateral direction x and is connected smoothly to the mating waiting connector as the waiting connector is engaged with the guiding surface 45. As a result, the shorting terminal 42 of the interlock connector 40 connects the pair of contact terminals of the waiting connector.

Finally, bolts are inserted into the insertion holes 12 of the mounting plates 11 on both ends of the cover main body 10 and screwed into bolt holes of the shield case. Thus, the seal cover is fixed to the upper surface of the case. In this state, the openings are closed by the holders 20A, 20B while being sealed uniformly over the entire periphery, and the energizing circuit inside is set in an energized state.

The bolts can be removed and the seal cover S can be pulled up to access the openings. Thus, the connector portion 44 of the interlock connector 40 is separated from the waiting connector so that the contact terminals are disconnected from each other to set the energizing circuit in a non-energized state. Thereafter, the first and second holders 20A, 20B are pulled out from the corresponding openings to open the openings.

As described above, the interlock connector 40 hanging down from the first holder 20A is inserted into the case and connected in a connecting direction CD to the waiting connector when the holders 20A, 20B arranged on the underside surface of the main body 10 are fit into the corresponding openings of the case. The axial centers of the waiting connector and the interlock connector 40 may deviate from each other due to a tolerance of the arrangement position of the waiting connector or the like. However, the interlock connector 40 is supported in the floating state and can move in directions substantially perpendicular to the connecting direction CD (i.e. forward, backward, left and right) with respect to the first holder 20. Thus, the interlock connector 40 is moved and centered to connect smoothly with the waiting connector so that the seal cover S is attached efficiently. Further, no unnecessary moving force acts on the first holder 20A in a radial direction as the interlock connector 40 and the waiting connector are connected. Thus, there is no possibility of squeezing the seal ring 25 unevenly in the circumferential direction and good sealing can be obtained over the entire periphery of the opening.

The interlock connector 40 could be mounted to float in four directions with respect to the first holder 20A by providing the lower surface of the first holder 20A with a mounting hole that is larger than the base of the interlock connector 40. The base then may be fit into the mounting hole through an opening in the lower surface of the base and the respective sides of the base may be engaged with resilient locking pieces on four sides of the mounting holes to support the base in a floating state. However, this structure is complicated since the resilient locking pieces need to be provided at four positions.

In contrast, this embodiment has the resilient locking piece 48 engaged with the engaging portion 51 to retain the base 43 of the interlock connector 40 when the base 43 is inserted a specified distance into the insertion groove 30 formed in the first holder 20A through the opening in the outer peripheral surface. Thus, the interlock connector 40 is supported in the floating state to be movable substantially perpendicular to the connecting direction CD (i.e. forward, backward, left and right). That is, the floating function can be realized by a simple structure including only one resilient locking piece 48.

The first holder 20A including the interlock connector 40 is supported in the floating state to move substantially perpendicular to the connecting direction CD (e.g. in all directions) on the underside surface of the cover main body 10 in this embodiment. Thus, the first holder 20A can be fit into the corresponding opening while being substantially centered, a squeeze amount of the seal ring 25 can be made more uniform over substantially the entire periphery and sealing ability of the opening is good.

The invention is not limited to the above described embodiment. For example, the following embodiments also are included in the scope of the invention.

Although the seal ring holder supporting the interlock connector itself is provided in the floating state on the underside surface of the main body in the above embodiment, it may be fixed on the underside surface of the main body.

Two work holes are formed in the shield case in the above embodiment However, the invention is applicable in the case where one, three or more openings are formed.

The openings are formed in the horizontal upper surface of the shield case in the above embodiment. However, the invention is applicable for a seal cover used when openings are formed in a vertical side surface or an oblique surface of a shield case.

The cover main body is not limited to a pressed part of a metal plate as described in the above embodiment and may be a die-cast product formed such as by aluminum die casting.

What is claimed is:

1. A seal cover for in-vehicle electric device to be removably attached to close an opening in a case that houses an electric device, the seal cover comprising:

a cover main body shaped to cover the opening of the case and to be attached to a surface of the case;

at least one seal ring holder on an underside of the cover main body and arranged to fit into the opening, the at least one seal ring holder having opposed top and bottom surfaces and an outer peripheral surface extending therebetween;

at least one insertion groove formed in the at least one seal ring holder, the at least one insertion groove having a first opening in the outer peripheral surface and a rear wall opposite the first opening to define a length dimension therebetween, first and second side walls extending between the first opening and the rear wall, the first and second side walls spaced from each other to define a width dimension therebetween, and a second opening in the bottom surface of the at least one seal ring holder in communication with the first opening;

at least one seal ring to be held in close contact with the opening; and at least one interlock connector having a base and a connector portion projecting from the base, the base having a length dimension smaller than the length dimension of the at least one insertion groove and a width dimension smaller than the width dimension of the at least one insertion groove, wherein the base of the at least one interlock connector is mounted in the at least one insertion groove so that a first clearance is formed in a length direction and a second clearance is formed in a width direction to allow lateral movement of the at least one interlock connector in the at least one insertion groove in a direction at an angle to a connecting direction to the waiting connector, and the connector portion projects from the second opening and is connectable to a waiting connector of the electric device for setting an electric member of the electric device in a specified electric state as being connected to or separated from the waiting connector.

2. The seal cover of claim 1, wherein the base includes at least one resilient locking piece projecting in an inserting direction of the base and resiliently engaged with an engaging portion in the insertion groove to retain the base.

3. The seal cover of claim 2, wherein the resilient locking piece is movable along the inserting direction between a position where the base is in contact with a back surface of the insertion groove and a position where the resilient locking piece is engaged with the engaging portion.

4. The seal cover of claim 1, wherein the seal ring holder is mounted on the cover main body to be movable in a direction substantially perpendicular to a fitting direction into the opening.

5. The seal cover of claim 1, wherein an insert nut is at least partly embedded in the seal ring holder and an insertion hole is provided in the cover main body so that a screw can be engaged into the insert nut to mount the seal ring holder to the cover main body and allow lateral movement of the seal ring holder in relation to the cover main body.

6. The seal cover of claim 5, wherein the nut is at least partly insertable into the insertion hole with a clearance.

7. The seal cover of claim 6, wherein a washer is arranged between the screw and the insertion hole.

8. The seal cover of claim 7, wherein a clearance is provided between the washer and the cover main body in an axial direction of the nut.

9. The seal cover of claim 6, wherein at least one pin is provided on one of the seal ring holder and the cover main body and at least one restricting hole is provided in the other of the seal ring holder and the cover main body for receiving the pin to prevent erroneous mounting of the seal ring holder on the cover main body and to prevent a rotational displacement of the seal ring holder with respect to the cover main body.

10. The seal cover of claim 9, wherein a clearance is provided between the pin and the restricting hole.

11. The seal cover of claim 10, wherein the clearance between the pin and the restricting hole is smaller than the clearance between the nut and the insertion hole.

12. A seal cover, comprising:

a cover main body having opposite inner and outer surfaces;

at least one seal ring holder mounted on the inner surface of the main body for lateral movement relative to the cover main body in directions transverse to a connecting direction, the at least one seal ring holder having opposed top and bottom surfaces and an outer peripheral surface extending therebetween;

at least one insertion groove formed in the at least one seal ring holder, the at least one insertion groove having a first opening in the outer peripheral surface and a second opening in the bottom surface of the at least one seal ring holder in communication with the first opening;

a seal ring mounted around the seal ring holder; and an interlock connector mounted in the at least one insertion groove and configured to move laterally in directions transverse to the connecting direction.

13. The seal cover of claim 12, wherein the base includes at least one resilient locking piece projecting in an inserting direction of the base and resiliently engaged with an engaging portion in the insertion groove to retain the base.

14. The seal cover of claim 12, wherein an insert nut is at least partly embedded in the seal ring holder and an insertion hole is provided in the cover main body, a screw being engaged with the insert nut to hold the seal ring holder on the cover main body.

15. The seal cover of claim 14, wherein the nut is at least partly insertable into the insertion hole with a clearance.

16. The seal cover of claim 15, wherein at least one pin is provided on one of the seal ring holder and the main body and at least one restricting hole is provided in the other of the seal ring holder and the cover main body for receiving the pin to prevent erroneous mounting of the seal ring holder on the cover main body and to prevent a rotational displacement of the seal ring holder with respect to the cover main body.

17. The seal cover of claim 16, wherein a clearance is provided between the pin and the restricting hole.

18. The seal cover of claim 17, wherein the clearance between the pin and the restricting hole is smaller than the clearance between the nut and the insertion hole.

* * * * *